US011192216B2

(12) United States Patent
Watanabe et al.

(10) Patent No.: US 11,192,216 B2
(45) Date of Patent: Dec. 7, 2021

(54) POLISHING METHOD AND POLISHING APPARATUS

(71) Applicant: EBARA CORPORATION, Tokyo (JP)

(72) Inventors: Hiromitsu Watanabe, Tokyo (JP); Kuniaki Yamaguchi, Tokyo (JP); Itsuki Kobata, Tokyo (JP); Yutaka Wada, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 676 days.

(21) Appl. No.: 15/898,028

(22) Filed: Feb. 15, 2018

(65) Prior Publication Data

US 2018/0169831 A1 Jun. 21, 2018

Related U.S. Application Data

(62) Division of application No. 14/520,242, filed on Oct. 21, 2014, now abandoned.

(30) Foreign Application Priority Data

Oct. 23, 2013 (JP) ..... 2013-220327

(51) Int. Cl.
*B24B 57/00* (2006.01)
*B24B 37/04* (2012.01)
*B24B 37/34* (2012.01)

(52) U.S. Cl.
CPC ..... *B24B 57/00* (2013.01); *B24B 37/04* (2013.01); *B24B 37/34* (2013.01)

(58) Field of Classification Search
CPC ..... B24B 57/00; B24B 37/04; B24B 37/34; B24B 37/042; B24B 57/02
(Continued)

(56) References Cited

U.S. PATENT DOCUMENTS 5,635,074 A * 6/1997 Stenstrom ..... B01D 33/808 210/739
5,664,990 A 9/1997 Adams et al.
(Continued)

FOREIGN PATENT DOCUMENTS

CN 201455812 U 5/2010
CN 201483369 U 5/2010
JP 2003-179012 6/2003

OTHER PUBLICATIONS

Singapore Patent Application No. 10201406812Y; Search Report; dated Nov. 2, 2016; 4 pages.

*Primary Examiner* — Joseph J Hail
*Assistant Examiner* — J Stephen Taylor
(74) *Attorney, Agent, or Firm* — BakerHostetler

(57) ABSTRACT

A polishing method of polishing a substrate while preventing coarse particles from being discharged onto a polishing pad is disclosed. In this polishing method, a substrate is brought into sliding contact with a polishing pad while a polishing liquid, which has passed through a filter, is supplied onto the polishing pad. The polishing method includes: passing the polishing liquid through the filter while increasing a physical quantity of the polishing liquid until the physical quantity reaches a predetermined set value, the physical quantity being one of flow rate and pressure of the polishing liquid; and polishing the substrate W on the polishing pad while supplying the polishing liquid that has passed through the filter onto the polishing pad.

6 Claims, 15 Drawing Sheets

(58) Field of Classification Search
USPC ..... 451/56
See application file for complete search history.

(56) References Cited

U.S. PATENT DOCUMENTS

| | | | | |
|---|---|---|---|---|
| 5,945,346 | A | 8/1999 | Vanell et al. | |
| 6,354,922 | B1 | 3/2002 | Sakurai et al. | |
| 6,527,969 | B1 | 3/2003 | Tanoue et al. | |
| 6,622,745 | B1 | 9/2003 | Smith et al. | |
| 6,629,881 | B1 | 10/2003 | Redeker et al. | |
| 6,659,848 | B1 | 12/2003 | Craig et al. | |
| 6,929,532 | B1 | 8/2005 | Seaman | |
| 2001/0000166 | A1 | 4/2001 | Tanoue et al. | |
| 2001/0010305 | A1 | 8/2001 | Takahashi | |
| 2002/0022441 | A1 | 2/2002 | Sugai | |
| 2002/0052115 | A1 | 5/2002 | Crevasse et al. | |
| 2002/0168926 | A1 | 11/2002 | Matsumoto et al. | |
| 2003/0054734 | A1 | 3/2003 | Mullee et al. | |
| 2004/0049301 | A1 | 3/2004 | Kawasaki | |
| 2006/0196541 | A1 | 9/2006 | Gerken et al. | |
| 2006/0205325 | A1* | 9/2006 | Abe | C23F 1/46 451/36 |
| 2010/0224256 | A1 | 9/2010 | Tseng et al. | |
| 2010/0285723 | A1 | 11/2010 | Lin et al. | |
| 2011/0008964 | A1 | 1/2011 | Hughes et al. | |
| 2011/0070811 | A1* | 3/2011 | Neuber | B24B 37/04 451/60 |
| 2011/0174745 | A1 | 7/2011 | Kim et al. | |
| 2011/0180512 | A1* | 7/2011 | Bosar | B24B 57/00 216/84 |
| 2013/0343910 | A1* | 12/2013 | Stephens | F04B 49/065 417/44.1 |
| 2015/0099431 | A1 | 4/2015 | Hong et al. | |

* cited by examiner

POLISHING METHOD AND POLISHING APPARATUS

CROSS REFERENCE TO RELATED APPLICATION

This application is a divisional of U.S. application Ser. No. 14/520,242, filed Oct. 21, 2014, which claims the priority to Japanese Patent Application No. 2013-220327, filed Oct. 23, 2013, the entire contents of which are incorporated herein by this reference.

BACKGROUND

In a manufacturing process of a semiconductor device, it increasingly becomes important to planarize a surface of the semiconductor device. The most important one of the planarizing technologies is chemical mechanical polishing (or CMP). This chemical mechanical polishing (which will be hereinafter referred to as CMP) is performed with use of a polishing apparatus, which is configured to supply a polishing liquid, containing abrasive particles such as silica ($SiO_2$) or ceria ($CeO_2$), onto a polishing pad while bringing a substrate, such as a water, into sliding contact with a polishing surface.

The polishing apparatus that performs CMP will be described with reference to FIG. 18. FIG. 18 is a schematic view of a typical polishing apparatus. As shown in FIG. 18, the polishing apparatus includes a polishing table 101 for supporting a polishing pad 100 having a polishing surface, and a top ring 102 for holding a substrate W, such as a wafer. Operations of this polishing apparatus when polishing the substrate W are as follows. The top ring 102 presses the substrate W against the polishing pad 100 at a predetermined pressure, while the polishing table 101 and the top ring 102 move relative to each other, to thereby bring the substrate W into sliding contact with the polishing pad 100. As a result, the substrate W is polished to have a planar and mirror surface.

When the substrate W is polished, a polishing liquid (or slurry) containing abrasive grains is supplied onto the polishing pad 100. Although the abrasive grains are fine particles, the abrasive grains may agglomerate together to form relatively large particles (which will be hereinafter referred to as coarse particles). If such coarse particles are delivered onto the polishing pad 100, these coarse particles may scratch the surface of the substrate W. In order to solve such a problem, a slurry supply line 103 is provided with a filter 104 for catching the coarse particles.

An on-off valve 105 is provided upstream of the filter 104. When the on-off valve 105 is opened, the slurry is delivered through the filter 104 onto the polishing pad 100. Since the coarse particles existing in the slurry are caught by the filter 104, the coarse particles are not discharged onto the polishing pad 100.

When the slurry is passing through the filter 104, pressure acting on an inlet side of the filter 104 becomes higher than pressure acting on an outlet side of the filter 104. If a pressure difference between the inlet side and the outlet side of the filter 104 is large, the coarse particles that have been once caught by the filter 104 are pushed out of the filter 104 and are discharged onto the polishing pad 100. As shown in FIG. 19, an amount of the coarse particles discharged increases in accordance with the increase in the pressure difference between the inlet side and the outlet side of the filter 104.

SUMMARY OF THE INVENTION

According to embodiments, there are provided a polishing method and a polishing apparatus capable of polishing a substrate while preventing coarse particles from being discharged onto a polishing pad.

Embodiments, which will be described below, relate to a polishing method and a polishing apparatus for polishing a substrate, such as a wafer, on a polishing pad while supplying a polishing liquid onto the polishing pad.

In a first aspect, there is provided a polishing method of polishing a substrate by bringing the substrate into sliding contact with a polishing pad while supplying a polishing liquid, which has passed through a filter, onto the polishing pad, comprising: passing the polishing liquid through the filter while increasing a physical quantity of the polishing liquid until the physical quantity reaches a predetermined set value, the physical quantity being one of flow rate and pressure of the polishing liquid; and polishing the substrate on the polishing pad while supplying the polishing liquid that has passed through the filter onto the polishing pad.

In a second aspect, there is provided a polishing method of polishing a substrate by bringing the substrate into sliding contact with a polishing pad while supplying a polishing liquid, which has passed through a filter, onto the polishing pad, comprising: performing a filter cleaning process of passing the polishing liquid intermittently through the filter when the substrate is not polished; and polishing the substrate on the polishing pad while supplying the polishing liquid that has passed through the filter onto the polishing pad.

In a third aspect, there is provided a polishing method of polishing a substrate by bringing the substrate into sliding contact with a polishing pad while supplying a polishing liquid, which has passed through a filter, onto the polishing pad, comprising: when the substrate is not polished, performing a filter cleaning process of passing the polishing liquid continuously through the filter while keeping a physical quantity of the polishing liquid larger than the physical quantity at which the substrate is to be polished, the physical quantity being one of flow rate and pressure of the polishing liquid; and polishing the substrate on the polishing pad while supplying the polishing liquid that has passed through the filter onto the polishing pad.

In a fourth aspect, there is provided a polishing apparatus for polishing a substrate by bringing the substrate into sliding contact with a polishing pad while supplying a polishing liquid onto the polishing pad, comprising: a polishing table configured to support the polishing pad; a top ring configured to press the substrate against the polishing pad; and a polishing-liquid supply structure configured to supply the polishing liquid onto the polishing pad, the polishing-liquid supply structure includes: a slurry supply nozzle configured to supply the polishing liquid onto the polishing pad; a filter coupled to the slurry supply nozzle; and a regulator configured to regulate a physical quantity of the polishing liquid that is to pass through the filter, the physical quantity being one of flow rate and pressure of the polishing liquid, the regulator being configured to increase the physical quantity until the physical quantity reaches a predetermined set value.

In a fifth aspect, there is provided a polishing apparatus for polishing a substrate by bringing the substrate into sliding contact with a polishing pad while supplying a polishing liquid onto the polishing pad, comprising: a polishing table configured to support the polishing pad; a top ring configured to press the substrate against the polishing pad; and a polishing-liquid supply structure configured to supply the polishing liquid onto the polishing pad, the polishing-liquid supply structure includes: a slurry supply nozzle configured to supply the polishing liquid onto the polishing pad; a delivery pipe configured to deliver the polishing liquid to the slurry supply nozzle; an on-off valve configured to open and close the delivery pipe; and a filter coupled to the delivery pipe, the on-off valve being configured to perform its opening and closing operations predetermined number of times to allow the polishing liquid to pass through the filter intermittently when the substrate is not polished.

In a sixth aspect, there is provided a polishing apparatus for polishing a substrate by bringing the substrate into sliding contact with a polishing pad while supplying a polishing liquid onto the polishing pad, comprising: a polishing table configured to support the polishing pad; a top ring configured to press the substrate against the polishing pad; and a polishing-liquid supply structure configured to supply the polishing liquid onto the polishing pad, the polishing-liquid supply structure includes: a slurry supply nozzle configured to supply the polishing liquid onto the polishing pad; a filter coupled to the slurry supply nozzle; and a regulator configured to regulate a physical quantity of the polishing liquid that is to pass through the filter, the physical quantity being one of flow rate and pressure of the polishing liquid, the polishing-liquid supply structure being configured to perform, when the substrate is not polished, a filter cleaning process of passing the polishing liquid continuously through the filter while keeping the physical quantity larger than the physical quantity at which the substrate is to be polished.

According to the above-described embodiments, the polishing liquid is passed through the filter while the physical quantity of the polishing liquid is increased, so that coarse particles that have been caught by the filter can be prevented from being discharged onto the polishing pad. This operation can prevent scratches on the substrate surface that would be formed by the coarse particles.

Further, according to the above-described embodiments, the polishing liquid is intermittently passed through the filter, so that the coarse particles that have been caught by the filter can be removed from the filter. This operation can prevent scratches on the substrate surface that would be formed by the coarse particles.

Further, according to the above-described embodiments, the polishing liquid is continuously passed through the filter at a high flow rate, so that the coarse particles that have been caught by the filter can be removed from the filter. This operation can prevent scratches on the substrate surface that would be formed by the coarse particles.

DESCRIPTION OF EMBODIMENTS

Figure 1:
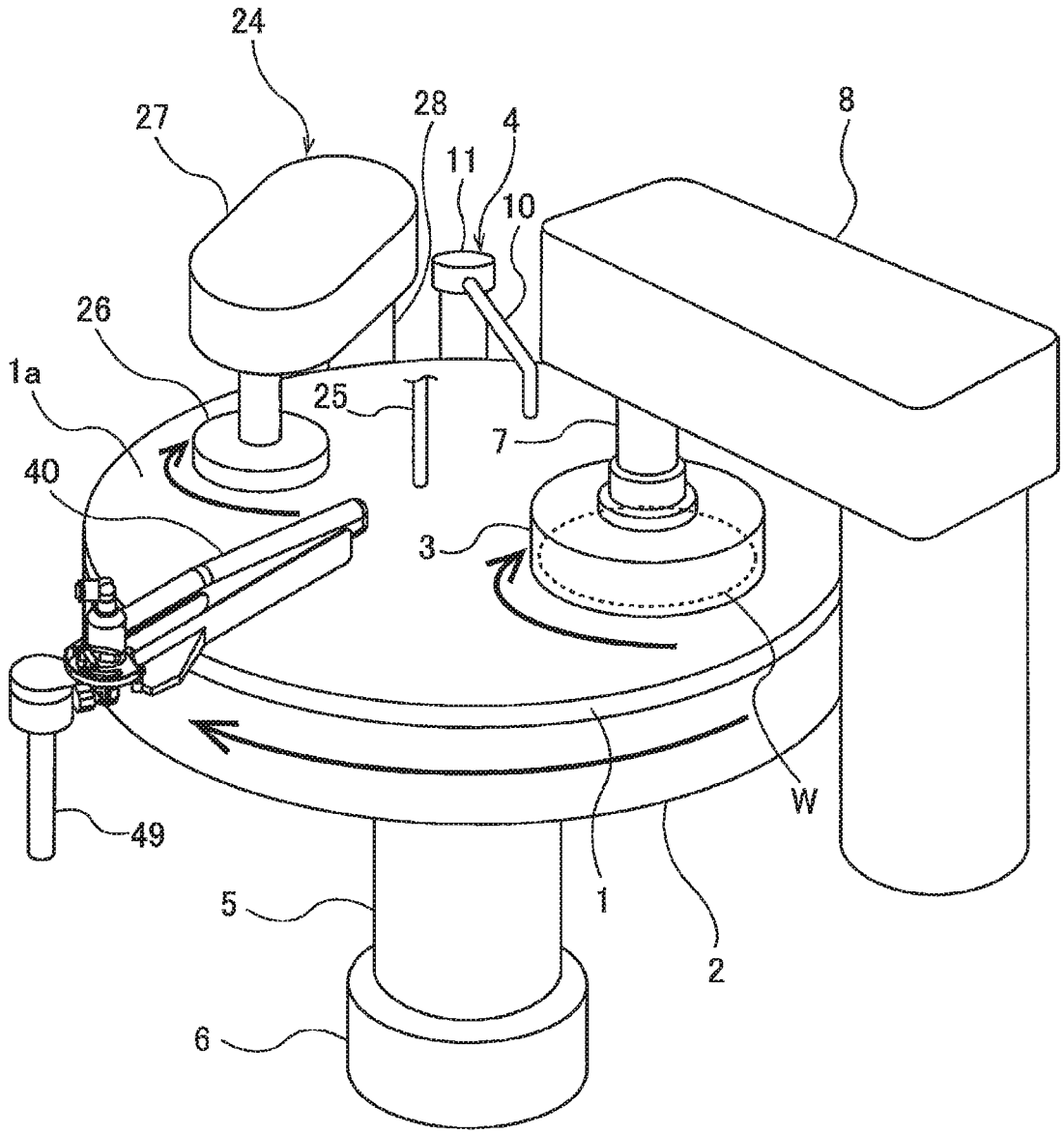
FIG. 1 is a perspective view of a polishing apparatus.

Embodiments will be described below with reference to the drawings, in FIGS. 1 through 17, identical or corresponding elements will be denoted by identical reference numerals, and repetitive descriptions thereof are omitted.

FIG. 1 is a perspective view showing a polishing apparatus. As shown in FIG. 1, the polishing apparatus includes a polishing table 2 for supporting a polishing pad 1 thereon, a top ring 3 for pressing a substrate W, such as a wafer, against the polishing pad 1, and a polishing-liquid supply structure 4 for supplying a polishing liquid (or slurry) onto the polishing pad 1.

The polishing table 2 is coupled via a table shaft 5 to a table motor 6 that is disposed below the polishing table 2, so that the polishing table 2 is rotated by the table motor 6 in a direction indicated by arrow. The polishing pad 1 is attached to an upper surface of the polishing table 2. The polishing pad 1 has an upper surface, which provides a polishing surface 1*a* for polishing the substrate W. The top ring 3 is secured to a lower end of a top ring shaft 7. The top ring 3 is configured to be able to hold the substrate W on its lower surface by vacuum suction. The top ring shaft 7 is coupled to a rotating device (not shown) disposed in a top ring arm 8, so that the top ring 3 is rotated by the rotating device through the top ring shaft 7.

The polishing apparatus further includes a dressing unit 24 for dressing the polishing pad 1. This dressing unit 24 includes a dresser 26 that is to rub against the polishing surface 1*a* of the polishing pad 1, a dresser arm 27 supporting the dresser 26, and a dresser pivot shaft 28 that causes the dresser arm 27 to pivot. As the dresser arm 27 pivots, the dresser 26 oscillates on the polishing surface 1*a*. The dresser 26 has a lower surface serving as a dressing surface constituted by a number of abrasive grains, such as diamond particles. The dresser 26 is configured to rotate while oscillating on the polishing surface 1*a* to slightly scrape away the polishing pad 1, thereby dressing the polishing surface 1*a*. During dressing of the polishing pad 1, pure water is supplied from a pure-water supply nozzle 25 onto the polishing surface 1*a* of the polishing pad 1.

The polishing apparatus further includes an atomizer 40 for cleaning the polishing surface 1*a* by spraying an atomized cleaning fluid onto the polishing surface 1*a* of the polishing pad 1. The cleaning fluid is a fluid containing at least a cleaning liquid (typically pure water). More specifically, the cleaning fluid may be composed of a fluid mixture of the cleaning liquid and a gas (e.g., an inert gas such as a nitrogen gas) or may be composed of only the cleaning liquid. The atomizer 40 extends in a radial direction of the polishing pad 1 (or the polishing table 2) and is supported by a support shaft 49. This support shaft 49 is located outside the polishing table 2. The atomizer 40 is located above the polishing surface 1*a* of the polishing pad 1. The atomizer 40 is configured to deliver a jet of the high-pressure cleaning fluid onto the polishing surface 1*a* to thereby remove polishing debris and the abrasive grains, contained in the polishing liquid, from the polishing surface 1*a* of the polishing pad 1.

Figure 2:
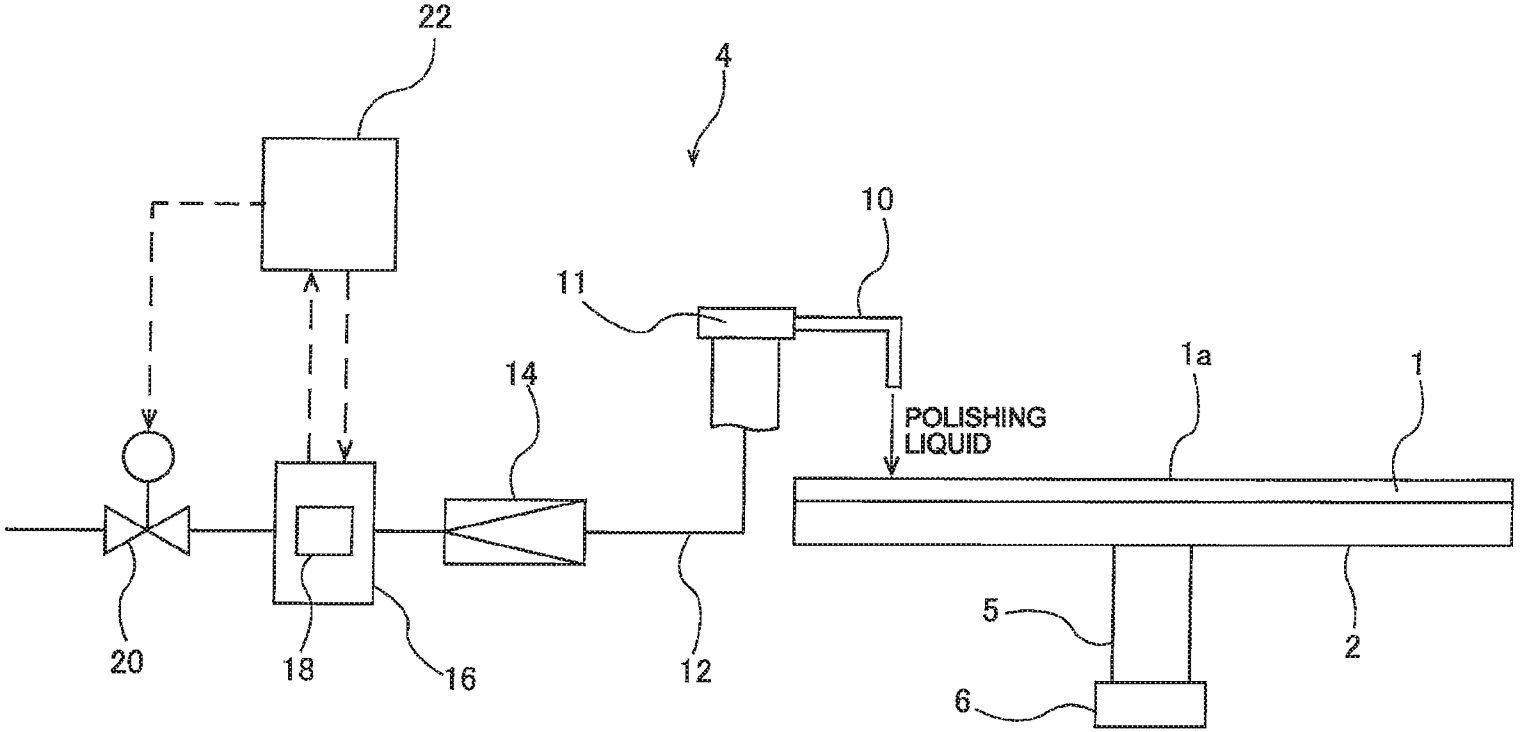
FIG. 2 is a schematic view of a polishing-liquid supply structure.
Figure 3:
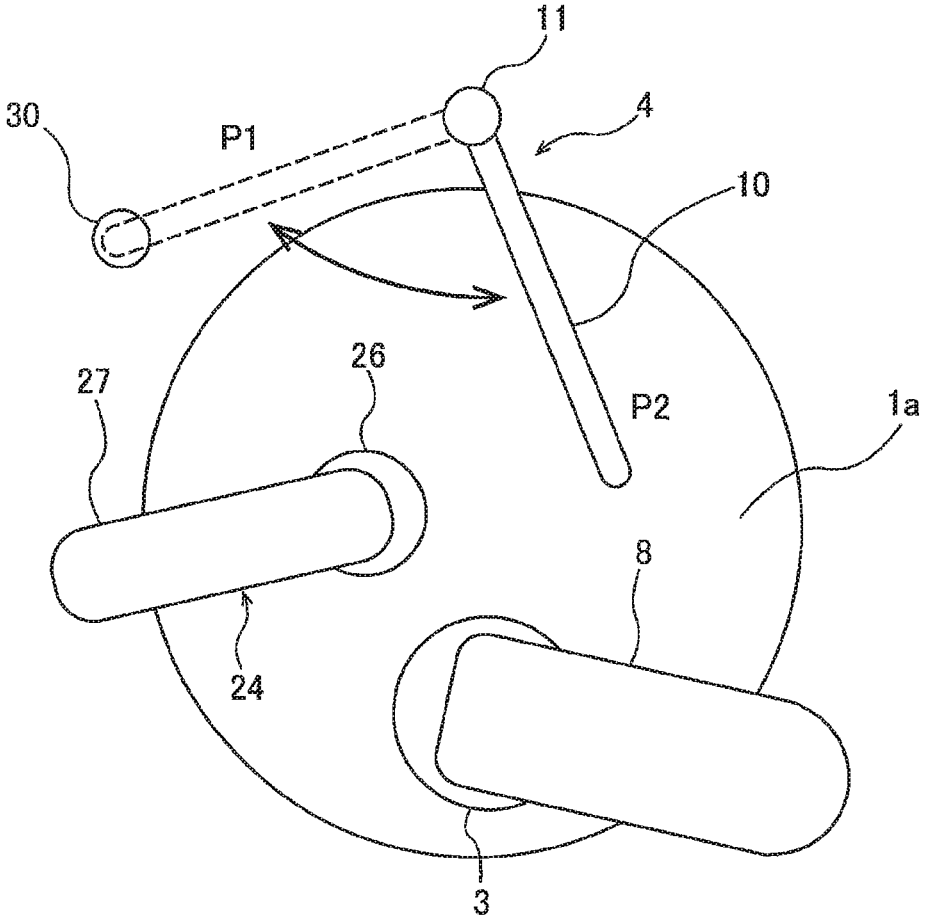
FIG. 3 is a plan view of the polishing apparatus shown in FIG. 1.

Next, the polishing-liquid supply structure 4 will be described with reference to FIG. 2 and FIG. 3. FIG. 2 is a schematic view of the polishing-liquid supply structure 4. FIG. 3 is a plan view of the polishing apparatus shown in FIG. 1. As shown in FIG. 2, the polishing-liquid supply structure 4 includes a slurry supply nozzle 10 for supplying the polishing liquid onto the polishing pad 1, a delivery pipe 12 that delivers the polishing liquid to the slurry supply nozzle 10, and a filter 14 that catches coarse particles contained in the polishing liquid. This filter 14 is configured to catch coarse particles each having a size equal to or larger than a predetermined size. The filter 14 is coupled to the delivery pipe 12 so that the polishing liquid, flowing in the delivery pipe 12, passes through the filter 14.

The delivery pipe 12 is coupled to the slurry supply nozzle 10. The polishing liquid that has passed through the filter 14 flows into the slurry supply nozzle 10. As shown in FIG. 3, the slurry supply nozzle 10 is fixed to a nozzle pivot shaft 11 and is configured to be able to pivot about the nozzle pivot shaft 11. The slurry supply nozzle 10 is configured to be able to move between a retreat position P1 where the slurry supply nozzle 10 is to discharge the polishing liquid outside the polishing pad 1 and a supply position P2 located above the polishing pad 1. In the retreat position P1, a drain inlet 30 is provided outside the polishing pad 1. It is noted that the drain inlet 30 is one example and any structure for discarding or recovering the polishing liquid may be provided at the retreat position P1.

The polishing-liquid supply structure 4 includes a regulator 16 for regulating a flow rate which is one of physical quantities of the polishing liquid, a flowmeter 18 configured to measure the flow rate of the polishing liquid, and a controller 22 configured to control operations of the regulator 16. The regulator 16 may be an electropneumatic regulator. The flowmeter 18 is located in the regulator 16. The flowmeter 18 may be located outside the regulator 16. An on-off valve 20 for opening and closing the delivery pipe 12 is provided upstream of the regulator 16. The filter 14 is located downstream of the regulator 16. The on-off valve 20, the regulator 16, and the filter 14 are arranged in this order in series. The filter 14 may be located upstream of the regulator 16.

The on-off valve 20 and the regulator 16 are coupled to the controller 22. The on-off valve 20 is configured to open and close the delivery pipe 12 in accordance with a command from the controller 22. The flowmeter 18 is configured to send a measured value of the flow rate to the controller 22. Based on the measured value of the flow rate, the controller 22 emits to the regulator 16 a command for regulating the flow rate of the polishing liquid. In accordance with the command from the controller 22, the regulator 16 regulates the flow rate of the polishing liquid flowing in the delivery pipe 12.

Polishing of the substrate W is performed as follows. First, the slurry supply nozzle 10 is moved from the retreat position P1 shown in FIG. 3 to the supply position P2 that is above the polishing pad 1. Subsequently, the top ring 3 and the polishing table 2 are rotated in respective directions indicated by arrows in FIG. 1, while the polishing liquid is supplied from the slurry supply nozzle 10 of the polishing-liquid supply structure 4 onto the polishing pad 1. In this state, the top ring 3 presses the substrate W against the polishing surface 1*a* of the polishing pad 1. The surface of the substrate W is polished by a mechanical action of the abrasive grains contained in the polishing liquid and a chemical action of a chemical component of the polishing liquid.

After polishing of the substrate W, the pure water is supplied from the pure water supply nozzle 25 onto the polishing pad 1 while the top ring 3 is pressing the substrate W against the polishing surface 1*a* of the polishing pad 1, thereby removing the polishing liquid from the surface of the substrate W. This process is called water polishing in which the substrate W is placed in sliding contact with the polishing pad 1 while the pure water is supplied onto the polishing pad 1. In this water polishing, the substrate W is not substantially polished. A pressing load exerted on the substrate W during the water polishing process is set to be smaller than a pressing load when the substrate W is polished in the presence of the polishing liquid. After the water polishing of the substrate W, the top ring 3, holding the substrate W, is moved outwardly of the polishing table 2. Subsequently, the dresser 26, while rotating about its own axis, oscillates on the polishing surface 1*a* of the polishing pad 1. The dresser 26 scrapes away the polishing pad 1 slightly to thereby dress the polishing pad 1. During dressing of the polishing pad 1, the pure water is supplied from the pure water supply nozzle 25 onto the polishing pad 1.

If a pressure difference between an inlet side and an outlet side of the filter 14 is large, overshoot of pressure occurs. This overshoot of pressure is a phenomenon in which pressure of the polishing liquid rises instantaneously when the polishing liquid is started to flow into the filter 14. Due to this overshoot, the coarse particles that have been caught in the filter 14 are pushed out of the filter 14 and are discharged onto the polishing pad 1. There is a correlation between the flow rate and the pressure of the polishing liquid. Accordingly, the pressure of the polishing liquid varies depending on a change in the flow rate of the polishing liquid. Therefore, the pressure difference between the inlet side and the outlet side of the filter 14 can be reduced by gradually increasing the flow rate of the polishing liquid. As a result, the overshoot can be prevented.

Figure 4:
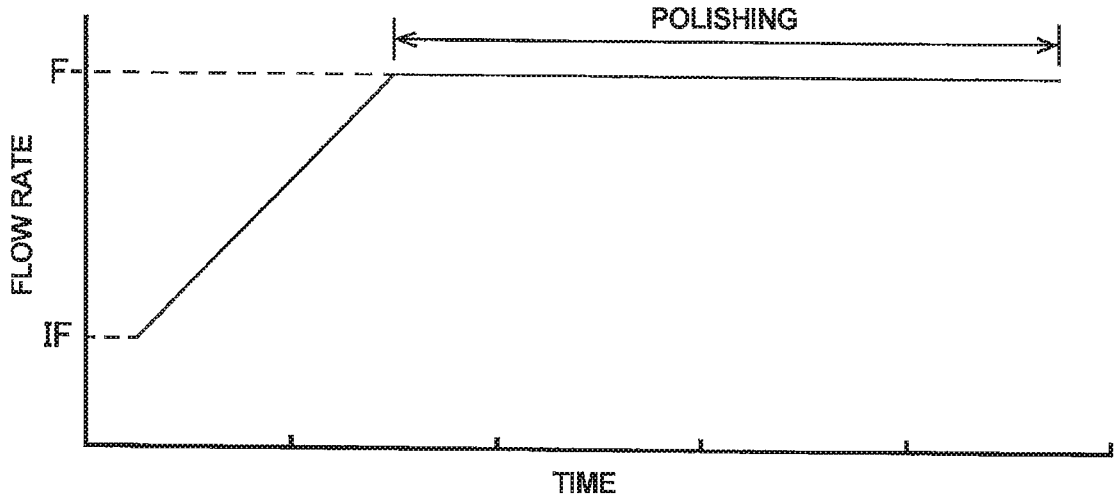
FIG. 4 is a graph showing a first embodiment.

FIG. 4 is a graph showing a first embodiment. In FIG. 4, horizontal axis represents time and vertical axis represents flow rate of the polishing liquid. As shown in FIG. 4, the flow rate of the polishing liquid is increased at a predetermined increasing rate from a predetermined initial value IF until the flow rate of the polishing liquid reaches a predetermined set value F. The initial value IF may be zero. After the flow rate of the polishing liquid has reached the predetermined set value F, the flow rate of the polishing liquid is kept constant. With the flow rate of the polishing liquid kept at the predetermined set value F, the substrate W is polished on the polishing pad 1.

More specific supply operations of the polishing liquid will be described. With the slurry supply nozzle 10 located at the supply position P2, the on-off valve 20 is opened in accordance with a command from the controller 22. After the supply of the polishing liquid is started, the controller 22 transmits to the regulator 16 a command for increasing the flow rate of the polishing liquid until the flow rate of the polishing liquid reaches the predetermined set value F. Upon receiving this command from the controller 22, the regulator 16 gradually increases the flow rate of the polishing liquid. When the flow rate of the polishing liquid reaches the predetermined set value F, the controller 22 controls the regulator 16 such that the flow rate of the polishing liquid is kept at the predetermined set value F. In this manner, the flow rate of the polishing liquid is increased gradually. Therefore, a sharp increase in the pressure difference between the inlet side and the outlet side of the filter 14 is prevented, and the coarse particles that have been caught by the filter 14 are prevented from being discharged onto the polishing pad 1. As a result, scratches on the surface of the substrate W are prevented.

Before the supply of the polishing liquid is started, the slurry supply nozzle 10 may be moved to the retreat position P1 so that the polishing liquid that has passed through the filter 14 is discharged into the drain inlet 30, located outside the polishing pad 1, until the flow rate of the polishing liquid reaches the predetermined set value F. Alternatively, the polishing liquid that has passed through the filter 14 may be recovered and returned to the polishing-liquid supply structure 4 for reuse. After the flow rate of the polishing liquid has reached the predetermined set value F, the slurry supply nozzle 10 is moved to the supply position P2 located above the polishing pad 1, so that the polishing liquid is supplied onto the polishing pad 1. By moving the slurry supply nozzle 10 in this manner, the coarse particles that have been caught by the filter 14 are more reliably prevented from being discharged onto the polishing pad 1.

Figure 5:
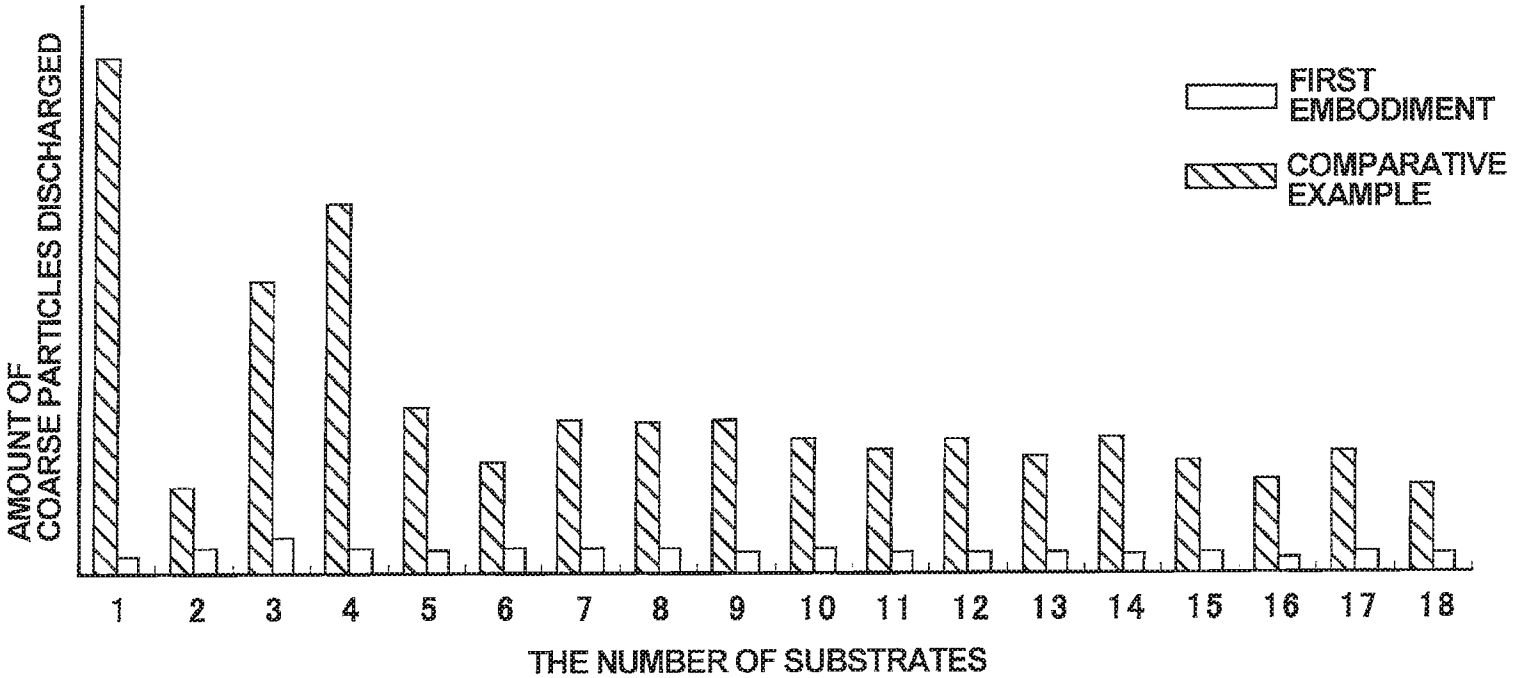
FIG. 5 is a graph showing an amount of coarse particles discharged and showing results of an experiment that was conducted according to the first embodiment.

FIG. 5 is a graph showing an amount of the coarse particles discharged and showing results of an experiment that was conducted according to the first embodiment. A comparative example shown in FIG. 5 shows an amount of the coarse particles discharged from the filter 14 according to a conventional polishing liquid supply method. Horizontal axis represents the number of substrates that have been polished, and vertical axis represents an amount of the coarse particles discharged from the filter 14. In the conventional polishing liquid supply method, the supply of the polishing liquid is started at a flow rate that is set for polishing of a substrate. As can be seen from FIG. 5, the amount of the coarse particles discharged can be remarkably reduced by gradually increasing the flow rate of the polishing liquid. Further, it can be seen from FIG. 5 that the amount of the coarse particles discharged can be kept low regardless of the number of substrates polished.

Figure 6:
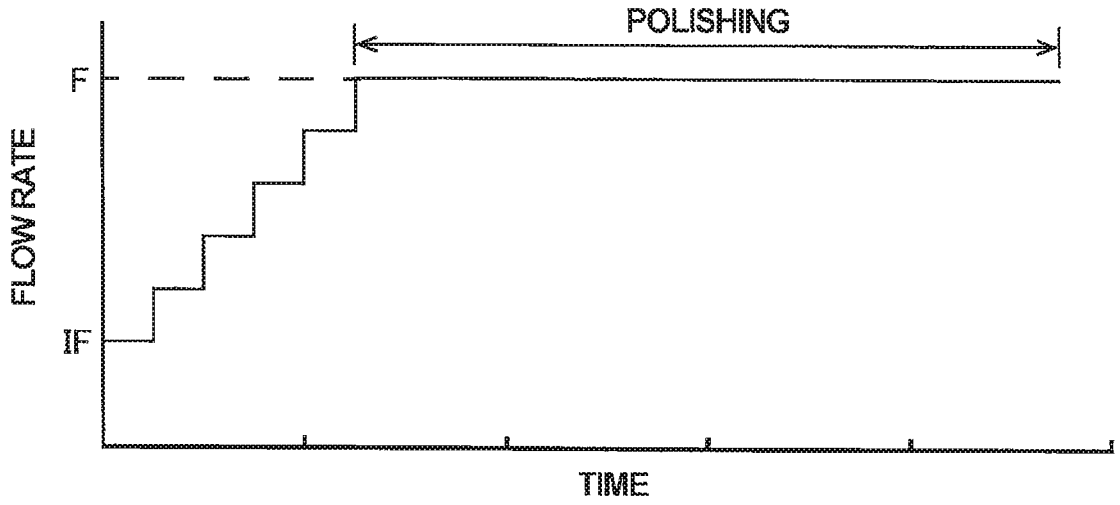
FIG. 6 is a graph showing a modification of the first embodiment.

FIG. 6 is a graph showing a modification of the first embodiment. In FIG. 6, horizontal axis represents time, and vertical axis represents flow rate of the polishing liquid. As shown in FIG. 6, the flow rate of the polishing liquid is increased gradually from the initial value IF in a stepwise manner until the flow rate of the polishing liquid reaches the predetermined set value F. The controller 22 controls the regulator 16 such that the flow rate of the polishing liquid increases gradually in a stepwise manner. After the flow rate of the polishing liquid has reached the predetermined set value F, the flow rate of the polishing liquid is kept constant.

Figure 7:
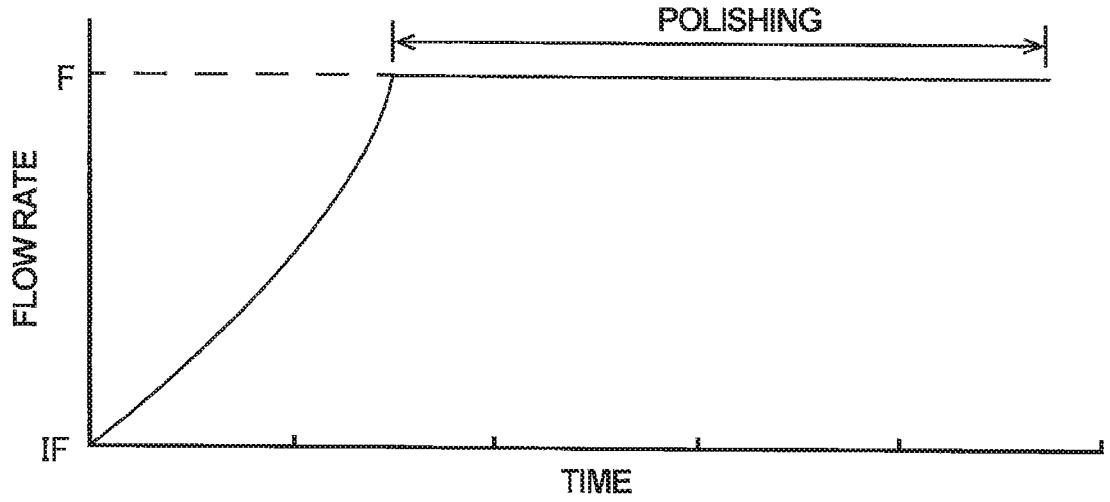
FIG. 7 is a graph showing another modification of the first embodiment.

FIG. 7 is a graph showing another modification of the first embodiment. In FIG. 7, horizontal axis represents time, and vertical axis represents flow rate of the polishing liquid. As shown in FIG. 7, the flow rate of the polishing liquid is increased in a curve (quadratic curve) until the flow rate of the polishing liquid reaches the predetermined set value F. The controller 22 controls the regulator 16 such that the flow rate of the polishing liquid increases in a quadratic curve. After the flow rate of the polishing liquid has reached the predetermined set value F, the flow rate of the polishing liquid is kept constant.

Figure 8:
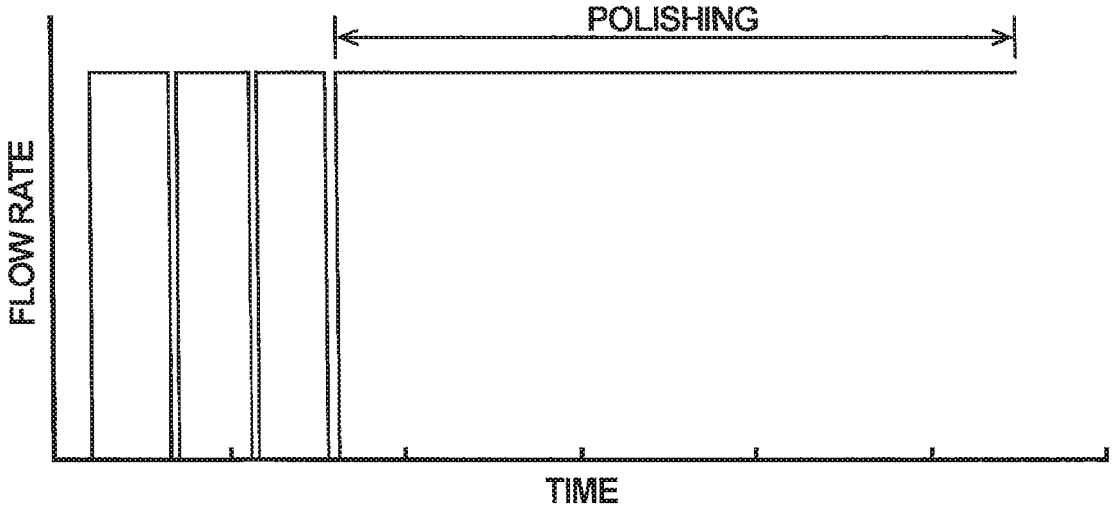
FIG. 8 is a graph showing a second embodiment.

FIG. 8 is a graph showing a second embodiment. In FIG. 8, horizontal axis represents time, and vertical axis represents flow rate of the polishing liquid. As shown in FIG. 8, before polishing of the substrate W is started, the polishing liquid is intermittently passed through the filter 14. Thereafter, the flow rate of the polishing liquid is kept constant, and the polishing liquid is supplied continuously through the filter 14 onto the polishing pad 1. In this state, the substrate W is polished. The flow rate of the polishing liquid when being intermittently passed through the filter 14 is the same as the flow rate of the polishing liquid when the substrate W is being polished. In the following descriptions, the operation of intermittently passing the polishing liquid through the filter 14 may be referred to as intermittent supply of the polishing liquid.

The purpose of the above-discussed first embodiment is to prevent the coarse particles that have been caught by the filter 14 from being discharged onto the polishing pad 1 by gradually increasing the flow rate of the polishing liquid. In contrast, the purpose of the second embodiment is to positively remove from the filter 14 the coarse particles that have been caught by the filter 14 by intermittently supplying the polishing liquid to the filter 14. When the polishing liquid is supplied intermittently, the pressure difference between the inlet side and the outlet side of the filter 14 increases repetitively, thus causing the overshoot of the pressure. As the overshoot occurs, a force of pushing the coarse particles out of the filter 14 is instantaneously applied to the filter 14, thereby removing the coarse particles from the filter 14.

Such intermittent supply of the polishing liquid is a filter cleaning process that removes the coarse particles from the filter 14. Passing the polishing liquid through the filter 14 intermittently (or periodically) means passing the polishing liquid through the filter 14 while switching the flow rate of the polishing liquid between a first value and a second value alternately. The second value is larger than the first value. The first value may be zero. During the filter cleaning process, the first value and the second value may be varied.

The filter cleaning process is performed when the substrate W is not polished. Examples of "when the substrate W is not polished" include before polishing of the substrate W, during the water polishing of the substrate W, during dressing of the polishing pad 1, during cleaning of the polishing surface 1*a* with the atomizer 40, and during a standby operation of the polishing apparatus. The standby operation of the polishing apparatus is an operation state of the polishing apparatus when no substrate is present on the polishing pad 1 and neither dressing of the polishing pad 1 nor cleaning of the polishing surface 1*a* is being performed.

The controller 22 may be configured to judge whether the polishing apparatus is in the standby operation or not. If the controller 22 judges that the polishing apparatus is in the standby operation, the controller 22 controls the on-off valve 20 so as to start the intermittent supply of the polishing liquid. The on-off valve 20 performs its opening and closing operations predetermined number of times to intermittently pass the polishing liquid through the filter 14, thereby removing the coarse particles from the filter 14. Since the polishing liquid is supplied when the polishing apparatus is in the standby operation in this manner, polishing of a new substrate can be performed with use of the filter 14 from which the coarse particles have been removed.

The intermittent supply of the polishing liquid may be performed at either the retreat position P1 or the supply position P2. When the intermittent supply of the polishing liquid is performed at the supply position P2, the coarse particles fall onto the polishing pad 1. Therefore, after the intermittent supply of the polishing liquid is terminated, the polishing surface 1*a* of the polishing pad 1 is cleaned by a pad cleaning structure. In this embodiment, the pad cleaning structure is constituted by the atomizer 40, or a combination of the above-described dresser 24 and the pure water supply nozzle 25.

When the intermittent supply of the polishing liquid is performed at the retreat position P1, the polishing liquid that has passed through the filter 14 is discharged into the drain inlet 30 that is provided outside the polishing pad 1. Alternatively, the polishing liquid that has passed through the filter 14 may be recovered and may be returned to the polishing-liquid supply structure 4 for reuse. In these cases, the coarse particles do not fall onto the polishing pad 1. Therefore, the process of cleaning the polishing pad 1 may be omitted. From a viewpoint of improving a throughput of the polishing apparatus, it is preferable to perform the intermittent supply of the polishing liquid at the retreat position P1.

Specific operation of supplying the polishing liquid will be described. When the substrate W is not being polished, the filter cleaning process is performed. More specifically, the opening and closing operations of the on-off valve 20 are performed the predetermined number of times. As the opening and closing operations of the on-off valve 20 are repeated, supply of the polishing liquid and stop of the supply are repeated. As a result, the polishing liquid is intermittently passed through the filter 14. In the filter cleaning process, a time interval during which the polishing liquid is supplied is set to be longer than a time interval during which the supply of the polishing liquid is stopped. The above-described predetermined number of times the opening and closing operations of the on-off valve 20 are repeated, i.e., the number of times supply and stop of the supply of the polishing liquid are repeated, is at least one time. In the embodiment shown in FIG. 8, supply and stop of the supply of the polishing liquid (i.e., the opening and closing operations of the on-off valve 20) are repeated three times. After the filter cleaning process is terminated, the substrate W is polished on the polishing pad 1 while the polishing liquid is supplied onto the polishing pad 1 at a preset flow rate.

Figure 9:
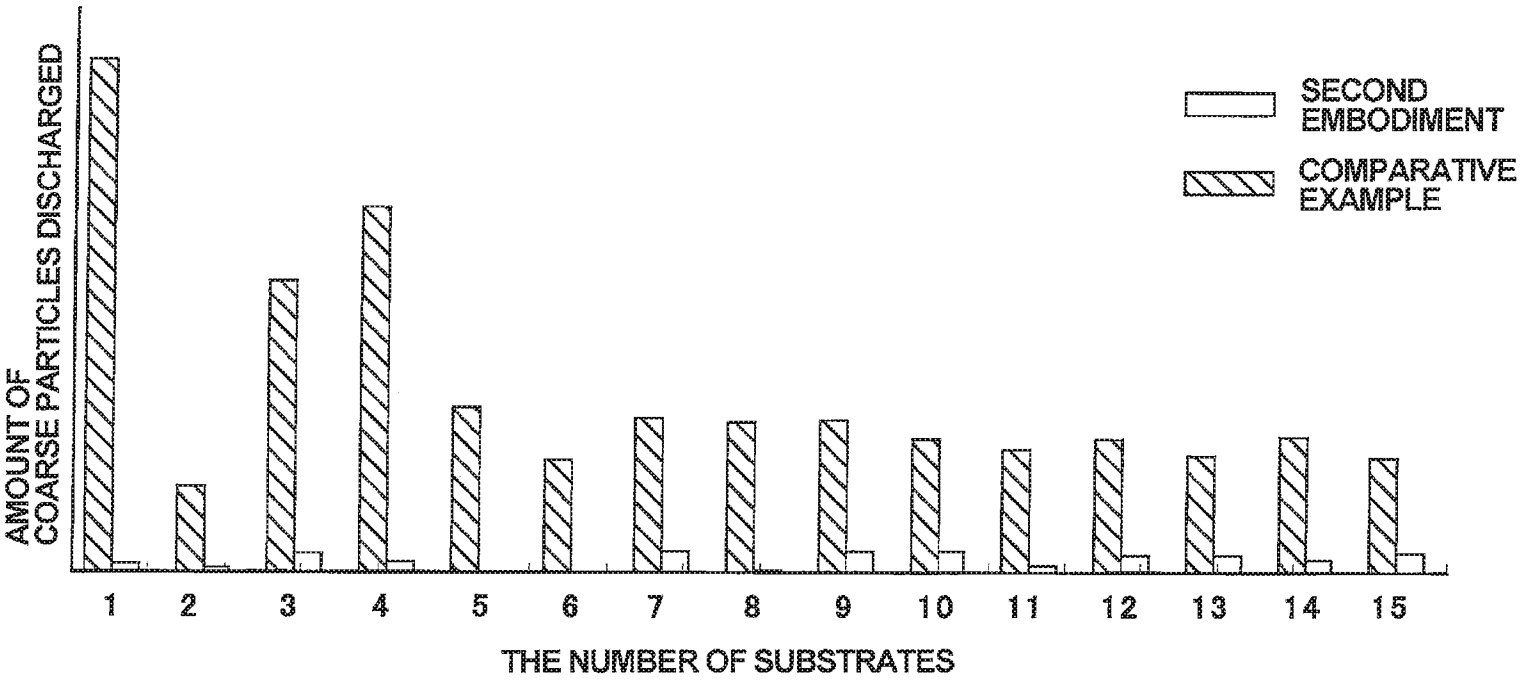
FIG. 9 is a graph showing an amount of coarse particles discharged after a filter cleaning process was performed according to the second embodiment.

FIG. 9 is a graph showing an amount of coarse particles discharged after the filter cleaning process was performed according to the second embodiment. A comparative example shown in FIG. 9 shows an amount of the coarse particles discharged from the filter 14 according to a conventional polishing liquid supply method. Horizontal axis represents the number of substrates that have been polished, and vertical axis represents an amount of the coarse particles discharged from the filter 14 that has been cleaned by the filter cleaning process. As can be seen from FIG. 9, the amount of the coarse particles discharged from the filter 14 during polishing can be remarkably reduced by intermittently passing the polishing liquid through the filter 14 in advance.

Figure 10:
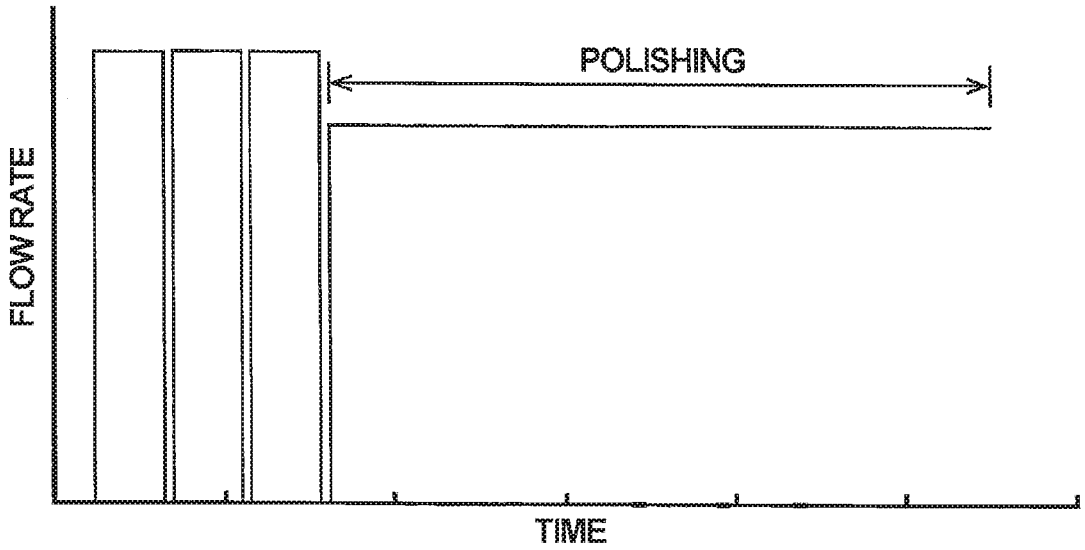
FIG. 10 is a graph showing a modification of the second embodiment.
Figure 11:
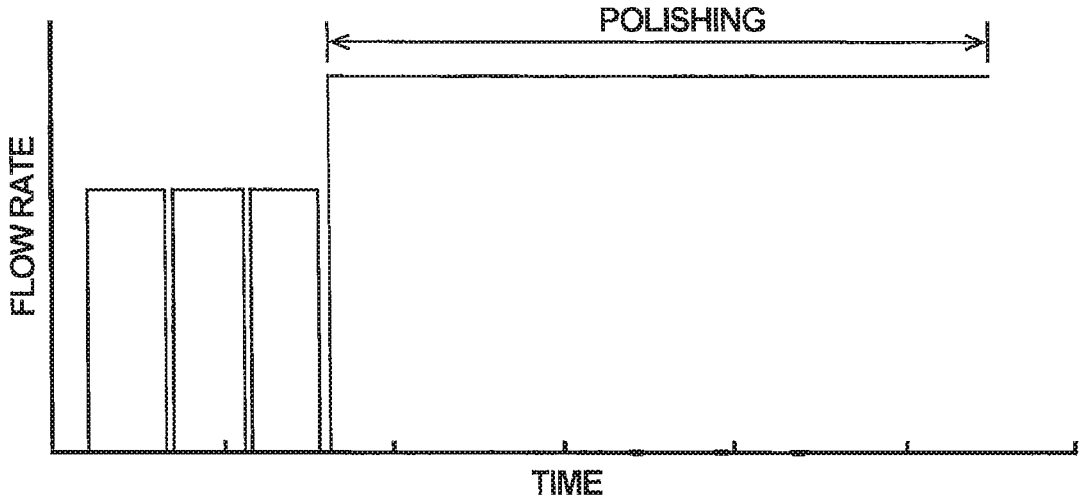
FIG. 11 is a graph showing another modification of the second embodiment.

FIG. 10 is a graph showing a modification of the second embodiment, and FIG. 11 is a graph showing another modification of the second embodiment. In FIG. 10 and FIG. 11, horizontal axis represents time, and vertical axis represents flow rate of the polishing liquid. As shown in FIG. 10, the flow rate of the polishing liquid during the intermittent supply thereof may be higher than the flow rate of the polishing liquid when the substrate W is being polished. As shown in FIG. 11, the flow rate of the polishing liquid during the intermittent supply thereof may be lower than the flow rate of the polishing liquid when the substrate W is being polished.

Figure 12:
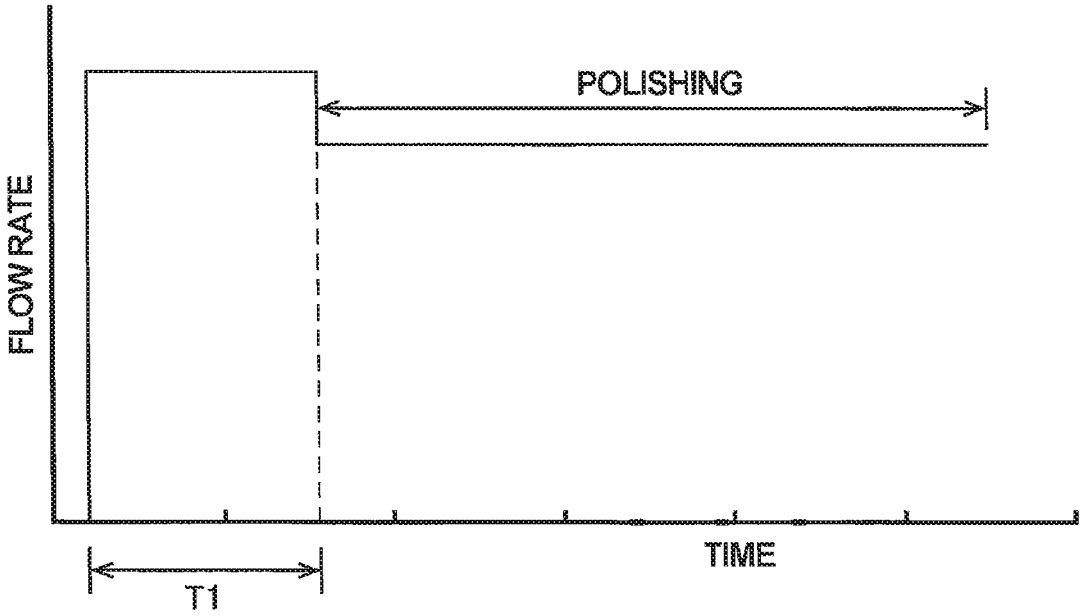
FIG. 12 is a graph showing a third embodiment.

FIG. 12 is a graph showing a third embodiment. In FIG. 12, horizontal axis represents time, and vertical axis represents flow rate of the polishing liquid. As shown in FIG. 12, before the substrate W is polished, the polishing liquid is continuously supplied to the filter 14 for a predetermined time T1 at a flow rate that is equal to or higher than a flow rate at which polishing is to be performed. The polishing liquid, when passing through the filter 14 at a high flow rate, can remove from the filter 14 the coarse particles that have been caught by the filter 14. Specifically, when the polishing liquid is supplied to the filter 14 at a flow rate that is equal to or higher than a flow rate at which polishing is to be performed, the pressure difference between the inlet side and the outlet side of the filter 14 is increased. Therefore, a force of pushing the coarse particles out of the filter 14 is continuously applied to the filter 14. As a result, the coarse particles that have been caught by the filter 14 can be removed from the filter 14. In the following descriptions, passing the polishing liquid through the filter 14 at a flow rate that is equal to or higher than a flow rate at which polishing is to be performed may be referred to as a high-flow-rate supply of the polishing liquid.

The high-flow-rate supply of the polishing liquid is a filter cleaning process of removing the coarse particles from the filter 14. This filter cleaning process is performed when the substrate W is not being polished. The high-flow-rate supply of the polishing liquid may be performed at either the retreat position P1 or the supply position P2 shown in FIG. 3. When the high-flow-rate supply of the polishing liquid is performed at the supply position P2, the coarse particles fall onto the polishing pad 1. Therefore, after the high-flow-rate supply of the polishing liquid is terminated, the polishing surface 1*a* of the polishing pad 1 is cleaned by the above-mentioned pad cleaning structure. In this embodiment, the pad cleaning structure is constituted by the atomizer 40, or a combination of the above-described dresser 24 and the pure water supply nozzle 25.

When the high-flow-rate supply of the polishing liquid is performed at the retreat position P1, the polishing liquid that has passed through the filter 14 is discharged into the drain inlet 30 that is provided outside the polishing pad 1. Alternatively, the polishing liquid that has passed through the filter 14 may be recovered and may be returned to the polishing-liquid supply structure 4 for reuse. In these cases, the coarse particles do not fall onto the polishing pad 1. Therefore, the process of cleaning the polishing pad 1 may be omitted. From a viewpoint of improving a throughput of the polishing apparatus, it is preferable to perform the high-flow-rate supply of the polishing liquid at the retreat position P1.

Specific operation of supplying the polishing liquid will be described. The on-off valve 20 is opened for the predetermined time T1, so that the polishing liquid is supplied to the filter 14 at a flow rate equal to or higher than a flow rate at which polishing is to be performed. The flow rate of the polishing liquid is controlled by the regulator 16 in accordance with a command from the controller 22. This high-flow-rate supply of the polishing liquid is the above-described filter cleaning process, which is performed for the predetermined time T1. After the filter cleaning process, the controller 22 controls the regulator 16 such that the flow rate of the polishing liquid is lowered to a set value for substrate polishing (which corresponds to the above-described set value F). The substrate W is then polished on the polishing pad 1 while the polishing liquid is supplied onto the polishing pad 1 at the above-described set value.

Figure 13:
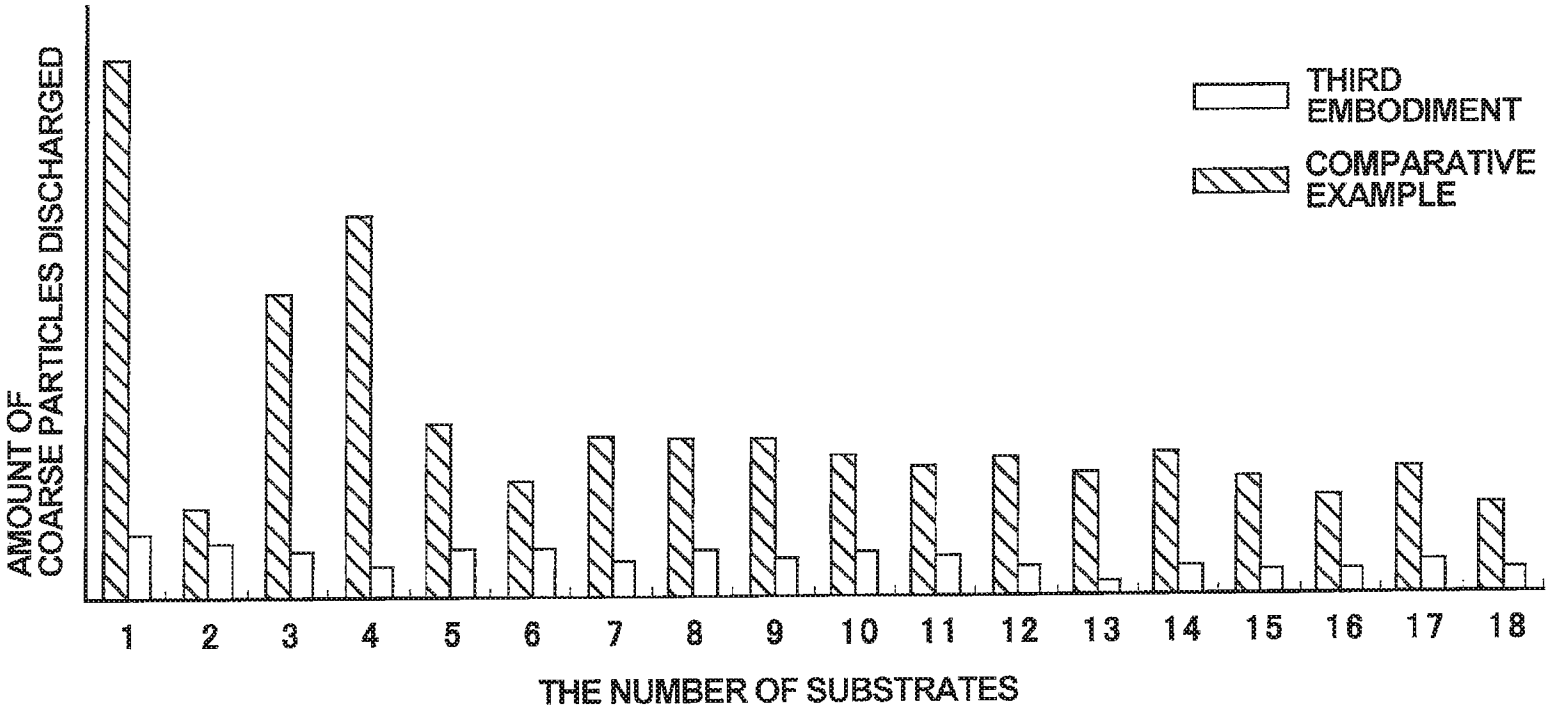
FIG. 13 is a graph showing an amount of coarse particles discharged after a filter cleaning process was performed according to the third embodiment.

FIG. 13 is a graph showing an amount of the coarse particles discharged after the filter cleaning process was performed according to the third embodiment. A comparative example shown in FIG. 13 shows an amount of the coarse particles discharged from the filter 14 according to a conventional polishing liquid supply method. Horizontal axis represents the number of substrates that have been polished, and vertical axis represents an amount of the coarse particles discharged from the filter 14 that has been cleaned by the filter cleaning process. As can be seen from FIG. 13, the amount of the coarse particles discharged during polishing can be remarkably reduced by passing the polishing liquid through the filter 14 at a high flow rate in advance.

Figure 14:
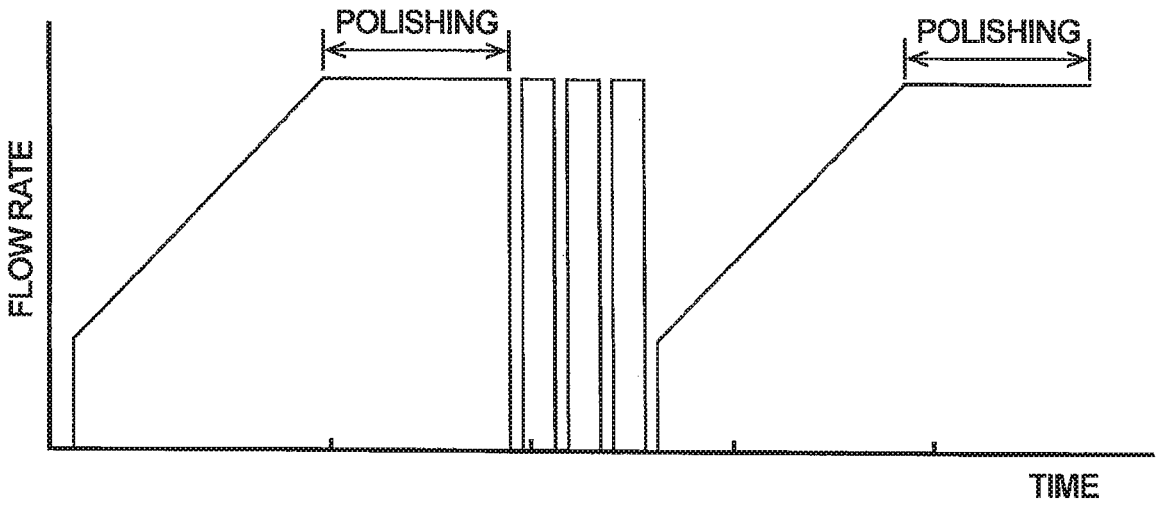
FIG. 14 is a graph showing a combination of the first embodiment and the second embodiment.

As shown in FIG. 14, the first embodiment and the second embodiment may be combined. In FIG. 14, horizontal axis represents time, and vertical axis represents flow rate of the polishing liquid. As shown in FIG. 14, the flow rate of the polishing liquid is increased gradually from an initial value until the flow rate of the polishing liquid reaches a predetermined set value. After the flow rate of the polishing liquid has reached the predetermined set value, the flow rate of the polishing liquid is kept constant. In this state, the substrate W is polished. After polishing of the substrate W is terminated, the supply of the polishing liquid is stopped. The substrate W that has been polished is transported to a subsequent process.

Until a next substrate is transported onto the polishing pad 1, the polishing liquid is intermittently supplied to the filter 14 to thereby remove the coarse particles from the filter 14. In the embodiment shown in FIG. 14, the flow rate of the polishing liquid when being intermittently supplied to the filter 14 is the same as a flow rate of the polishing liquid when the substrate is being polished. The intermittent supply of the polishing liquid comprises the supply of the polishing liquid and the stop of the supply of the polishing liquid. After the supply of the polishing liquid and the stop of the supply of the polishing liquid are repeated the predetermined number of times, a next substrate is transported onto the polishing pad 1, and the flow rate of the polishing liquid is then increased gradually from a predetermined initial value until the flow rate of the polishing liquid reaches the predetermined set value again. After the flow rate of the polishing liquid has reached the predetermined set value, the flow rate of the polishing liquid is kept constant. In this state, the substrate is polished on the polishing pad 1.

Figure 15:
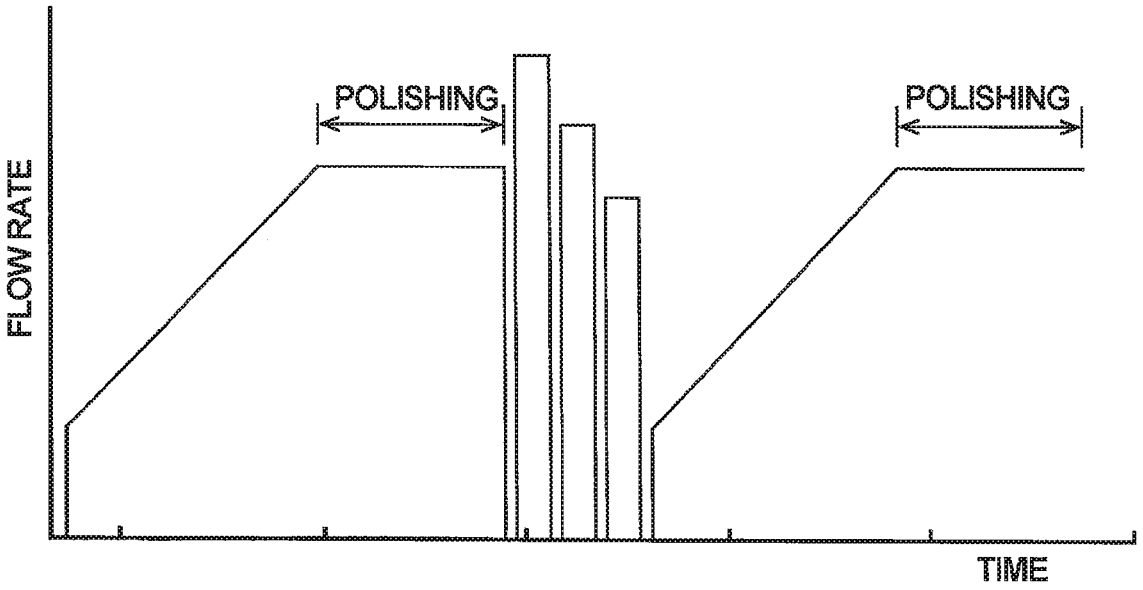
FIG. 15 is a graph showing a combination of the first embodiment and the modification of the second embodiment.

As shown in FIG. 15, the first embodiment and the modification of the second embodiment may be combined. In FIG. 15, horizontal axis represents time, and vertical axis represents flow rate of the polishing liquid. As shown in FIG. 15, the flow rate of the polishing liquid is increased gradually from an initial value until the flow rate of the polishing liquid reaches a predetermined set value. After the flow rate of the polishing liquid has reached the predetermined set value, the flow rate of the polishing liquid is kept constant. In this state, the substrate W is polished. After polishing of the substrate W is terminated, the supply of the polishing liquid is stopped. The substrate W that has been polished is transported to a subsequent process.

Until a next substrate is transported onto the polishing pad 1, the polishing liquid is intermittently supplied to the filter 14 to thereby perform the filter cleaning process. In the embodiment shown in FIG. 15, the flow rate of the polishing liquid in an initial stage of the filter cleaning process is higher than the flow rate of the polishing liquid when a substrate is to be polished. Each time the supply of the polishing liquid and the stop of the supply of the polishing liquid are repeated, the flow rate of the polishing liquid is lowered, until the flow rate of the polishing liquid in a final stage of the filter cleaning process is lower than the flow rate of the polishing liquid when a substrate is polished. After the filter cleaning process is terminated, the next substrate is transported onto the polishing pad 1, and the flow rate of the polishing liquid is then increased gradually from a predetermined initial value until the flow rate of the polishing liquid reaches the predetermined set value again. After the flow rate of the polishing liquid has reached the predetermined set value, the flow rate of the polishing liquid is kept constant. In this state, the substrate is polished on the polishing pad 1.

Figure 16:
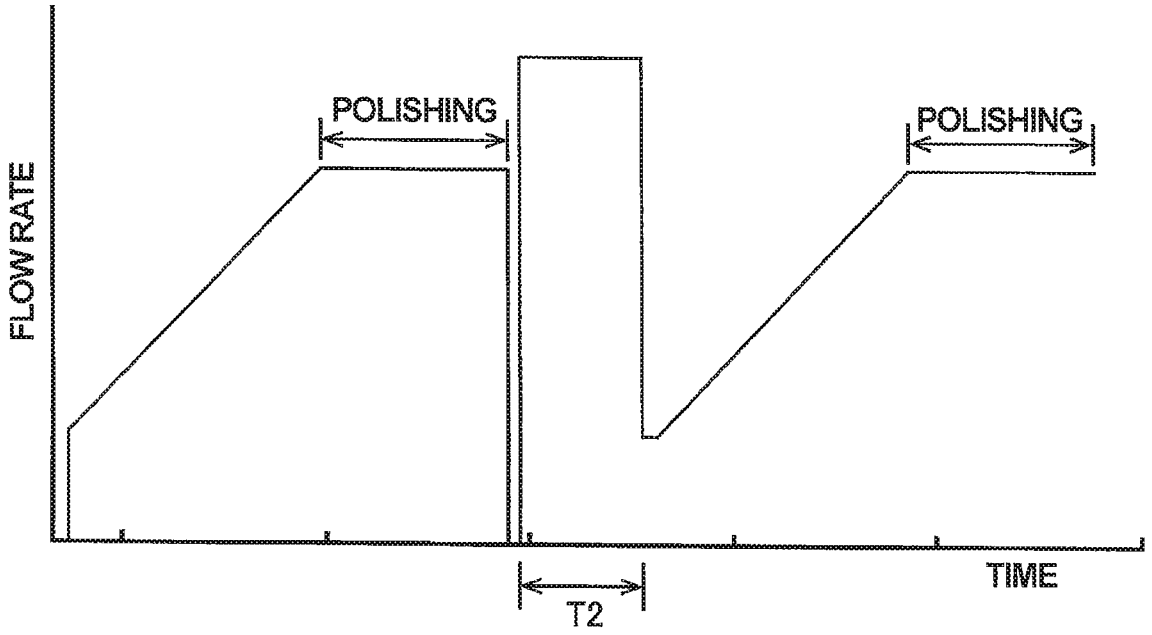
FIG. 16 is a graph showing a combination of the first embodiment and the third embodiment.

As shown in FIG. 16, the first embodiment and the third embodiment may be combined. In FIG. 16, horizontal axis represents time, and vertical axis represents flow rate of the polishing liquid. As shown in FIG. 16, the flow rate of the polishing liquid is increased gradually from a predetermined initial value until the flow rate of the polishing liquid reaches a predetermined set value. After the flow rate of the polishing liquid has reached the predetermined set value, the flow rate of the polishing liquid is kept constant. In this state, the substrate W is polished. After polishing of the substrate W is terminated, the supply of the polishing liquid is stopped. The substrate W that has been polished is transported to a subsequent process.

Before a next substrate is polished, the polishing liquid is continuously supplied to the filter 14 for a predetermined time T2 at a flow rate equal to or higher than a flow rate of the polishing liquid at which a substrate is to be polished, thereby removing the coarse particles from the filter 14. After the predetermined time T2 has elapsed, the flow rate of the polishing liquid is once reduced to the predetermined initial value, and is then increased until the flow rate of the polishing liquid reaches the predetermined set value again. After the flow rate of the polishing liquid has reached the predetermined set value, the flow rate of the polishing liquid is kept constant. In this state, the next substrate is polished on the polishing pad 1.

Figure 17:
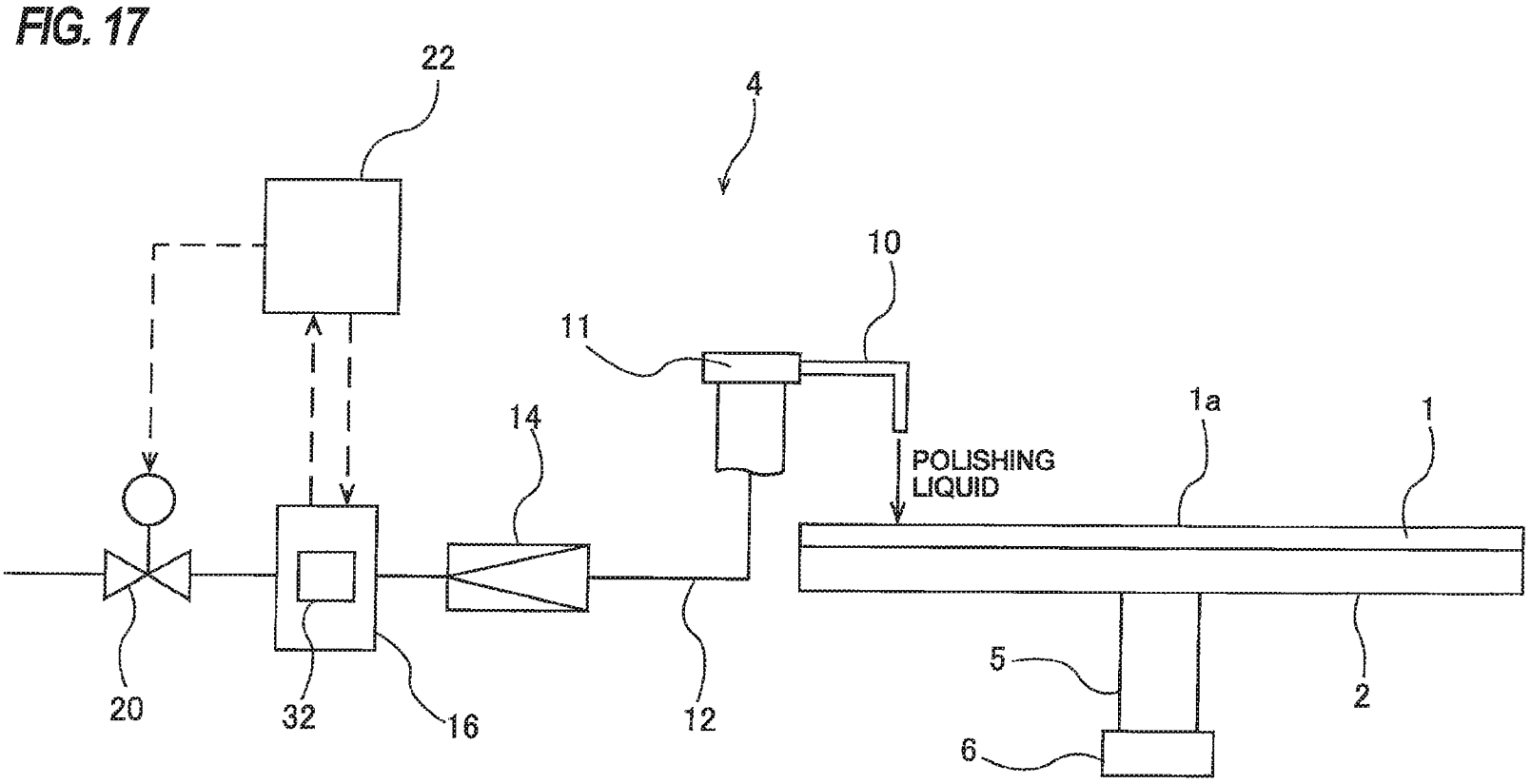
FIG. 17 is a view showing a polishing-liquid supply structure having a pressure gauge, instead of a flowmeter.
Figure 18:
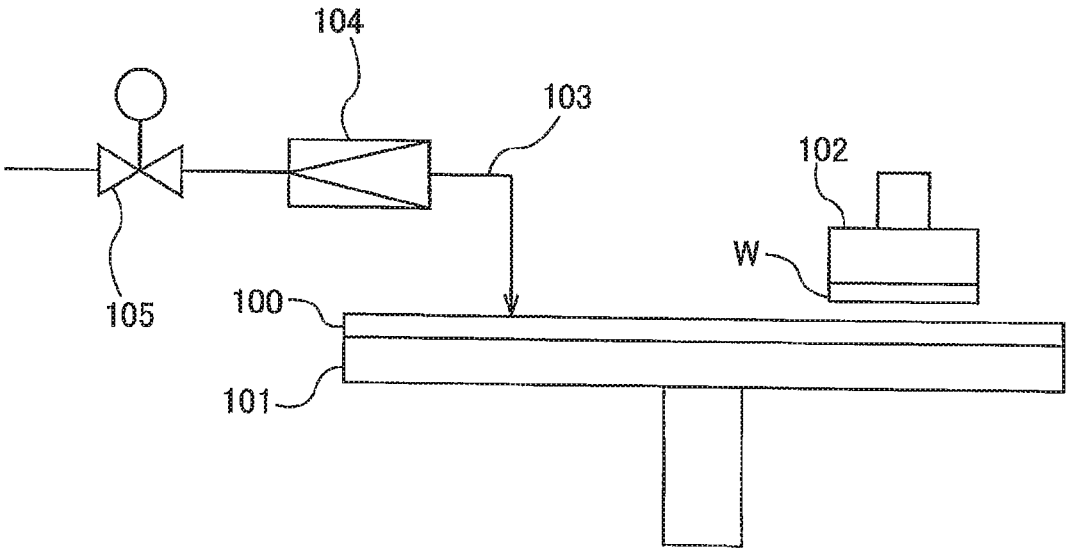
FIG. 18 is a schematic view of a typical polishing apparatus.
Figure 19:
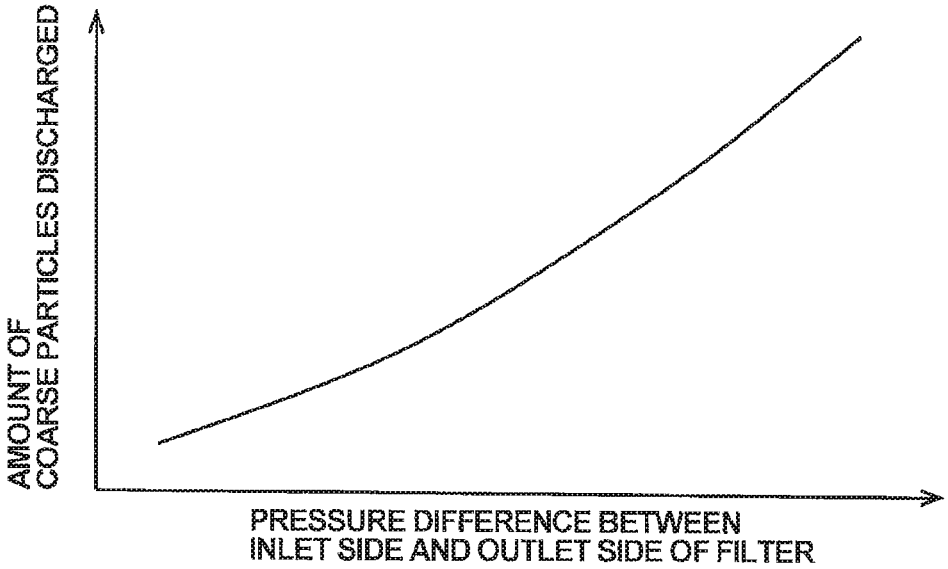
FIG. 19 is a graph showing an amount of coarse particles discharged and a pressure difference between an inlet side and an outlet side of a filter.

As shown in FIG. 17, the polishing-liquid supply structure 4 may include a pressure gauge 32, instead of the flowmeter 18. In this embodiment, the regulator 16 is configured to regulate pressure of the polishing liquid according to a command from the controller 22. The pressure gauge 32 may be provided outside the regulator 16. There is a correlation between the flow rate and the pressure of the polishing liquid. Therefore, the pressure of the polishing liquid changes in the same manner as the flow rate of the polishing liquid. Specifically, as the flow rate of the polishing liquid increases, the pressure of the polishing liquid also increases, while as the flow rate of the polishing liquid decreases, the pressure of the polishing liquid also decreases. Therefore, the pressure of the polishing liquid behaves in the same manner as the flow rate of the polishing liquid as illustrated in FIG. 4 through FIG. 16. For this reason, graphs with respect to the pressure of the polishing liquid are omitted. Both the flow rate and the pressure of the polishing liquid are physical quantities of the polishing liquid. A physical quantity to be monitored is selected in advance, and the polishing-liquid supply structure 4 is constructed base on the selected physical quantity (i.e., the flow rate or the pressure).

Although the embodiments of the present invention have been described above, it should be noted that the present invention is not limited to the above embodiments, and may be reduced to practice in various different embodiments within the scope of the technical concept of the invention.

What is claimed is:

1. A polishing apparatus comprising:

a polishing table configured to support a polishing pad;

a top ring configured to press a substrate against the polishing pad; and a polishing-liquid supply structure configured to supply a polishing liquid onto the polishing pad; and a controller configured to transmit instructions to control the top ring and the polishing liquid supply structure, the polishing-liquid supply structure including:

a slurry supply nozzle configured to supply the polishing liquid onto the polishing pad;

a valve coupled to the slurry supply nozzle;

a filter coupled to the slurry supply nozzle; and a regulator configured to regulate a physical quantity of the polishing liquid that is to pass through the filter, the physical quantity being one of flow rate and pressure of the polishing liquid, wherein the controller is configured to:

instruct the valve to open to start supply of the polishing liquid onto the polishing pad while passing the polishing liquid through the filter;

after staffing of the supply of the polishing liquid, instruct the regulator to increase the physical quantity of the polishing liquid in a stepwise manner until the physical quantity reaches a predetermined set value;

after the physical quantity has reached the predetermined set value, instruct the regulator to keep the physical quantity constant; and instruct the top ring to polish the substrate by bringing the substrate into sliding contact with the polishing pad while the polishing liquid is supplied onto the polishing pad, with the physical quantity being kept constant.

2. The polishing apparatus according to claim 1, wherein the slurry supply nozzle is configured to supply the polishing liquid that has passed through the filter onto the polishing pad until the physical quantity reaches the predetermined set value.

3. The polishing apparatus according to claim 1, wherein the slurry supply nozzle is configured to discharge the polishing liquid that has passed through the filter outside the polishing pad until the physical quantity reaches the predetermined set value.

4. A polishing apparatus comprising:

a polishing table configured to support a polishing pad;

a top ring configured to press a substrate against the polishing pad; and a polishing-liquid supply structure configured to supply a polishing liquid onto the polishing pad; and a controller configured to transmit instructions to control the top ring and the polishing-liquid supply structure, the polishing-liquid supply structure including:

a slurry supply nozzle configured to supply the polishing liquid onto the polishing pad;

a valve coupled to the slurry supply nozzle;

a filter coupled to the slurry supply nozzle; and a regulator configured to regulate a physical quantity of the polishing liquid that is to pass through the filter, the physical quantity being one of flow rate and pressure of the polishing liquid, wherein the controller is configured to:

instruct the valve to open to start supply of the polishing liquid onto the polishing pad while passing the polishing liquid through the filter;

after starting of the supply of the polishing liquid, instruct the regulator to increase the physical quantity of the polishing liquid in a quadratic curve until the physical quantity reaches a predetermined set value;

after the physical quantity has reached the predetermined set value, instruct the regulator to keep the physical quantity constant; and instruct the top ring to polish the substrate by bringing the substrate into sliding contact with the polishing pad while the polishing liquid is supplied onto the polishing pad, with the physical quantity being kept constant.

5. The polishing apparatus according to claim 4, wherein the slurry supply nozzle is configured to supply the polishing liquid that has passed through the filter onto the polishing pad until the physical quantity reaches the predetermined set value.

6. The polishing apparatus according to claim 4, wherein the slurry supply nozzle is configured to discharge the polishing liquid that has passed through the filter outside the polishing pad unto the physical quantity reaches the predetermined set value.

* * * * *